United States Patent [19]

Sydnor

[11] 3,955,497

[45] May 11, 1976

[54] BAR CODE PRINTING DEVICE

[76] Inventor: James Rawlings Sydnor, 1215 Palmyra Ave., Richmond, Va. 23227

[22] Filed: Sept. 18, 1974

[21] Appl. No.: 507,293

[52] U.S. Cl. ..... 101/93.25; 101/93.26; 101/95

[51] Int. Cl.[2] ..... B41J 1/40; B41J 1/54

[58] Field of Search ..... 101/94, 95, 96, 97, 101/98, 99, 100, 101, 102, 103, 106, 107, 108, 110, 59, 75, 79, 93

[56] References Cited

UNITED STATES PATENTS

| | | | |
|---|---|---|---|
| 778,741 | 12/1904 | Childs | 101/106 |
| 1,156,000 | 10/1915 | Engstrom | 101/97 |
| 1,576,823 | 3/1926 | Hayes | 101/97 |
| 1,863,828 | 6/1932 | Broman et al. | 101/106 X |
| 1,921,327 | 8/1933 | Schimmel et al. | 101/110 X |
| 2,519,008 | 8/1950 | Weimont | 101/110 X |
| 2,725,819 | 12/1955 | Floyd et al. | 101/94 X |
| 2,778,304 | 1/1957 | Juhas | 101/94 |
| 2,786,411 | 3/1957 | Welter | 101/97 X |
| 3,120,800 | 2/1964 | Ward | 101/79 X |
| 3,370,531 | 2/1968 | Falk | 101/108 X |
| 3,370,532 | 2/1968 | Falk | 101/103 X |
| 3,828,664 | 8/1974 | Dikoff | 101/110 X |

FOREIGN PATENTS OR APPLICATIONS

| | | | |
|---|---|---|---|
| 785,605 | 10/1957 | United Kingdom | 101/110 |

*Primary Examiner*—J. Reed Fisher

*Attorney, Agent, or Firm*—Larson, Taylor and Hinds

[57] ABSTRACT

An apparatus is disclosed for applying bar - half bar code to letter mail so as to permit electronically controlled mail sorting. The apparatus comprises a plurality of code wheels each having code printing elements on one surface and the corresponding numerals on the opposite surface, an inking source and a hinge mounted frame. Each wheel is manually controlled by an operator to code a desired numeral and in a preferred embodiment the surface of each wheel containing the number to be coded is enlarged to facilitate manipulation. Two flanges provided on a base permit ready alignment of a letter under the printing elements.

7 Claims, 3 Drawing Figures

BAR CODE PRINTING DEVICE

FIELD OF THE INVENTION

This invention relates to code printing devices and, more particularly, to a device for printing a bar - half bar code on a piece of letter mail.

BACKGROUND OF THE INVENTION

The U.S. Postal Service (U.S.P.S.) has adopted a numeric code, the well known zip code, for the identification of post offices and distribution centers. In order to permit mechanization of a previously labor-bound operation of sorting the mail, the U.S.P.S. has also adopted a binary bar - half bar code which can be printed on each letter, which can be electronically scanned, and which enables rapid sorting into appropriate bins. (See Postal Service Notice 23E, October 1972 "Guidelines for Designing and Printing Envelopes for Machine Processing.")

At present the U.S.P.S. applies the five digit zip code only to business reply envelopes and cards. This code, which is divided into two sections or groups of numbers, respectively comprising the first three numbers and the last two numbers, is encoded using straight binary code. For example, the zip code 15034 has a first section of 150 and a second section of 34. The number 150 in binary is 0010010110, using a ten bit representation, and the number 34 is represented by seven binary bits 0100010. The corresponding bar - half bar code for 150 is and for 34 is . Since straight binary and not a binary coded decimal is used, console encoding requires a computer capable of decimal to binary conversion and the sorting machines used require sophisticated logic circuitry to decode the characters.

SUMMARY OF THE INVENTION

According to the invention, a coding device is provided for a bar - half bar code (hereinafter referred to as a bar code) which utilizes the principles of binary coded decimals. This code approach permits simple and inexpensive encoding and decoding by small businesses and other mailers who desire to have their mail processed more rapidly and the coding device of the invention is particularly adapted to such a use.

According to a preferred embodiment thereof, the coding device includes a plurality of coding wheels, each wheel having along the edge surface thereof 10 groups of four bar - half bar printing elements, the four bit word formed by the printing elements representing one decimal digit. Diametrically opposed to each printing element is the decimal digit corresponding thereto. Thus, selection of a particular bar code is achieved by selecting a desired digit on the opposite side. The code wheels can be rotated by a finger and an alignment arrangement of spring loaded balls and depressions in each wheel provides detent positioning of the printing elements.

According to an important feature of the invention, the portion of the edge surface of each coding wheel presented to an operator, i.e., that containing the decimal digits, is enlarged in order to permit easier manipulation and rotation of the wheels. In addition, each wheel preferably includes two stop flanges to limit rotation to less than 180°, thus assuring that the wheels do not rotate beyond 0 or 9. The coding wheels are rotatable about a shaft mounted on a support plate that is connected by a hinge to a platform or base. The support plate has a window in the top thereof to permit manipulation and reading of the numerals on the coding wheels. Another window is provided to permit the printing elements of each wheel to protrude past the support plate, to contact an ink source, such as a webbing, and to be pressed against an envelope resting in between the support plate and the base. Two perpendicular flanges on the base provide positive alignment of the envelope under the printing elements.

Other features and advantages of the invention will be set forth in, or will be apparent from, a detailed description of the preferred embodiment found herein below.

DESCRIPTION OF THE PREFERRED EMBODIMENT

Figure 1:
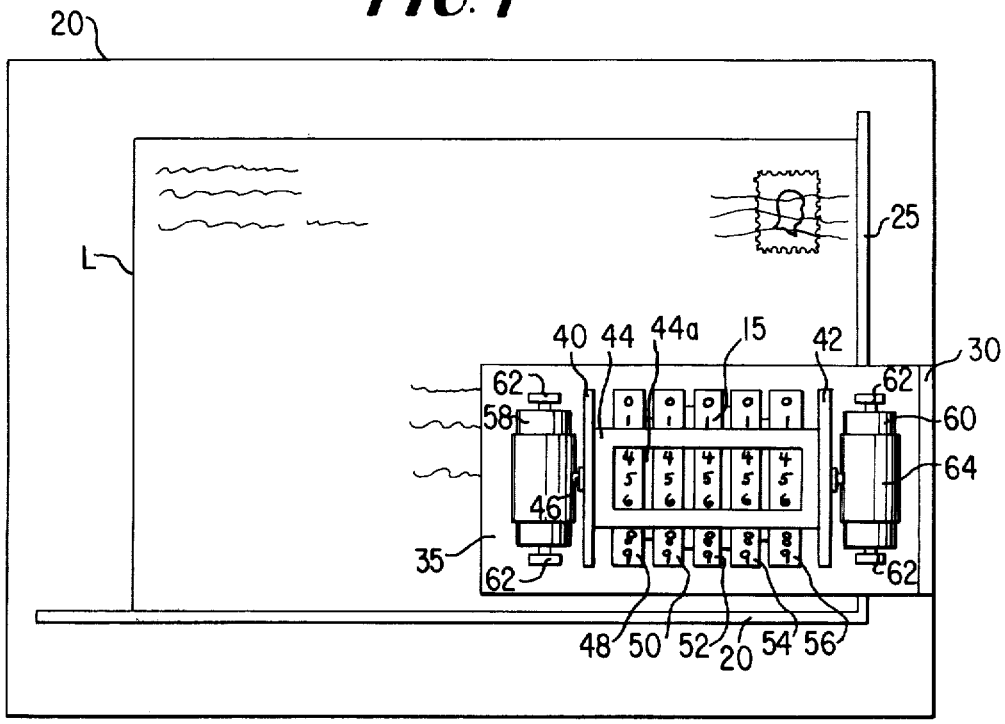
FIG. 1 is a plan view of a preferred embodiment of the coding device of the invention together with an envelope being encoded thereby.
Figure 2:
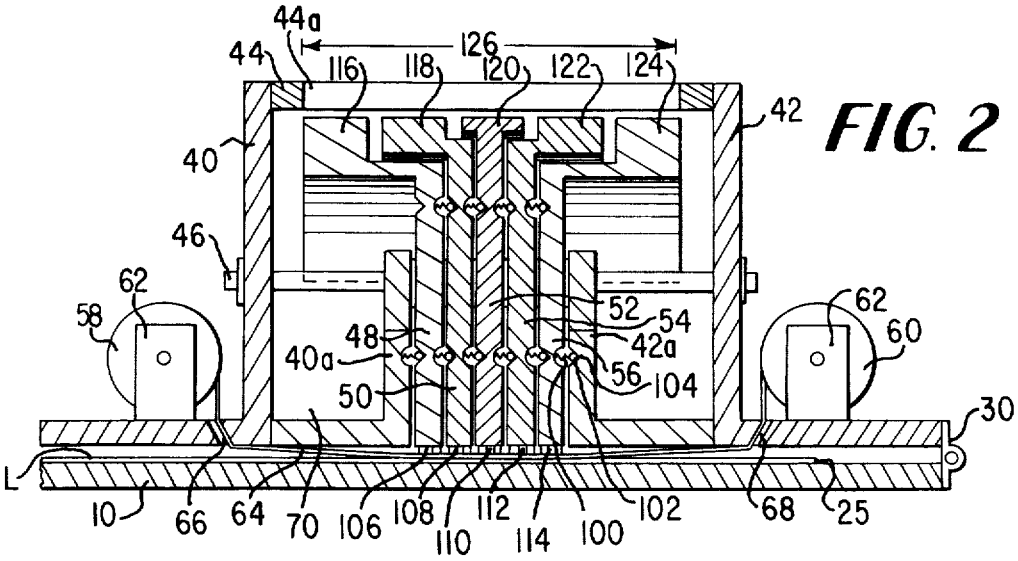
FIG. 2 is a transverse cross sectional view of the preferred embodiment of FIG. 1.

Referring to FIG. 1, a code printing assembly or coding device according to the invention is shown. The device includes a platform or base 10 which supports an envelope or letter L on which a barcode is to be printed. Two perpendicular flanges 20 and 25 are provided on base 10 to assure the proper location of the envelope L, the position of the envelope being fixed by locating a corner thereof in the corner formed by the flanges 20, 25. As shown in FIGS. 1 and 2 a support plate 35 is connected to base or platform 10 by a hinge 30, thereby permitting plate 35 to be lowered into contact with envelope L or raised away therefrom.

Two upright support columns 40 and 42 are mounted in spaced relationship on plate 35. An upper window member 44 having a window **44*a* thereon is supported between support columns 40 and 42, window 44*a* providing access to five coding wheels described hereinbelow. A shaft or axle 46 is fixedly mounted between lower portions of support columns 40 and 42**.

Five coding wheels 48, 50, 52, 54, and 56, are mounted for rotation on axle 46 relative thereto. The shapes of the individual coding wheels 48 to 56 are described in greater detail herein below. The edges or edge surfaces of the coding wheels facing an operator have the numerals 0 to 9 printed thereon as can best be seen in FIGS. 1 and 3, the numerals being collectively denoted 15. The opposite edge surfaces, i.e., the portions of the edge surfaces diametrically opposed to the portions containing the numerals have secured thereto bar - half bar printing elements 106, 108, 110, 112, 114 (see FIG. 2) representing each of these numerals in code. The printing elements protrude through an opening 70 in frame 35, as can most easily be seen in FIGS. 2 and 3.

Two pairs of upright support brackets 62 mounted on plate 35 adjacent to columns 40 and 42 respectively support spools 58 and 60 therebetween. As can be seen in FIG. 2, and inked webbing 64 passes around spool 58, through a first slot 66 in frame 35 under the printing elements 106 to 114, through a second slot 68 and around spool 60. Simple manual manipulation of either spool 58 or spool 60 can assure a satisfactory ink supply between the printing elements and envelope L at all times.

In order to print a bar code capable of being machine read, a detenting arrangement is provided which assures proper alignment of the code characters. Specifically, each coding wheel 48 to 56 has a spring 100 and a ball bearing 102 disposed on one side while on the other side of each wheel, a series of depressions 104 are provided in which corresponding ones of the spring-loaded balls 102 are respectively received. The depressions 104, as shown in FIG. 3, are spaced about the circumference of the corresponding wheel thus, as each wheel is turned, the wheel will be locked or detented into a precise, definite position in proper alignment with respect to the other wheels and with respect to supports 40, 42, owing to the provision of flanges 40*a* and 42*a* which are located adjacent to outermost wheels 48 and 56 and which serve as part of the detenting arrangement.

The U.S.P.S. guidelines require that print elements 106–114 be spaced at 32 lines to the inch. This uniform spacing necessitates a coding wheel that is only approximately one-eighth inch wide. It will be appreciated that five wheels having a total width of approximately five-eighth inch would be very difficult to manipulate by hand. According to a further important feature of the invention, the edge of each wheel facing an operator is enlarged so as to enable manipulation using the finger. More specifically, center wheel 52 is enlarged bilaterally and symmetrically to provide face or facing surface indicated at 120 of a comfortable width. Inner coding wheels 50 and 54 are also enlarged. Thus, with this arrangement, the individual widths of coding wheels 48–56 presented to the operator can be as large as desired without disturbing the spacing required for printing elements 106–114. It is noted that the specific embodiment illustrated in FIG. 2 is given by way of example only and other configurations can be used.

Figure 3:
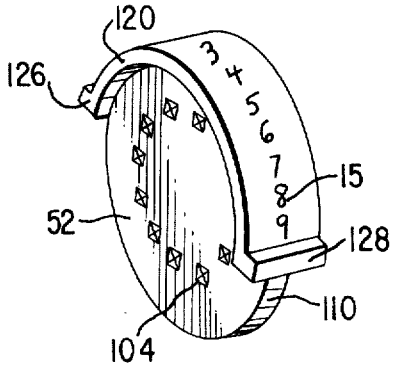
FIG. 3 is a perspective view of the center coding wheel of the embodiment of FIGS. 1 and 2.

Referring to FIG. 3, a perspective view of center wheel 52 is shown. Wheel 52 includes first and second flanges 126 and 128 located at either end of enlarged edge or surface 120 which protrude radially from wheel 52 and engage a stop member or bar (not shown) mounted in the path thereof and supported between support columns 40 and 42, parallel to shaft 46. A second stop (not shown) is mounted on the support columns 40 and 42 on the opposite side of wheels 48 to 56. Thus, the coding wheels 48 to 56 are free to rotate on shaft 46 until one of the flanges 126, 128 engages one of the stops at which time the wheel is prevented from turning past the point where printing elements are properly positioned.

In operation, an operator first dials a desired zip code on the five coding wheels 48–56 using his finger. Plate 35 is then lifted on hinge 30 permitting insertion of envelope L against positioning flanges 20 and 25. When 35 is lowered again, the printing elements, corresponding to the desired zip code and protruding past frame 35, press against ink webbing 64 and cause a bar code to be printed on letter 15. Frame 35 is then raised to allow removal of the printed envelope L.

An example of the 4 bit bar - half bar code for coding wheels 48–56 is as follows:

| | | | |
|---|---|---|---|
| 0 | ,,,, | 5 | ,I,I |
| 1 | ,,,I | 6 | ,II, |
| 2 | ,,I, | 7 | ,III |
| 3 | ,,II | 8 | I,,, |
| 4 | ,I,, | 9 | I,,I |

Thus, the bar code for zip code 15034 is

,,,I,I,I,,,,,,,II,I,,

Other variations of binary coded decimals are known in the art and can be applied to bar - half bar coding.

In an alternative arrangement (not shown), the coding wheel assembly can be spring mounted so as to permit vertical movement on a support that is either hinged or rigidly fastened to a base, with a space being provided between the support and the base to permit insertion of an envelope under the coding wheels. The operator would then press down on the coding wheels so as to bring them into contact with the envelope and thereby printing a bar code on the envelope. In a similar manner, the coding wheel assembly could be mounted in a hand-stamp assembly which does not include a hinge or base, and ink can be applied by an external source, such as by use of an ink pad.

Although the invention has been described with respect to an exemplary embodiment thereof, it will be understood that variations and modifications can be effected in these embodiments without departing from the scope and spirit of the present invention.

I claim:

1. An apparatus for printing bar-half bar codes on mailing envelopes comprising:

a support member;

a plurality of individually rotatable coding wheels adapted to be individually manually rotated by a user to the desired positions, each of said coding wheels having a plurality of bar-half bar code printing elements along a portion of the peripheral edge surface thereof and a like number of numerals individually corresponding to each of said plurality of bar-half bar code printing elements along a further portion of said peripheral edge surface, each printing element being located diametrically opposite to the numeral corresponding thereto so that rotation of a said coding wheel to a selected position wherein a desired numeral is selected to be printed in code causes the corresponding printing elements to be moved to a printing position, the width of said portion of the peripheral edge surface of said coding wheels containing said numerals being adapted to be directly manipulated by a user and being greater than the width of the edge surface containing said printing elements so as to facilitate manual manipulation of said coding wheels, the said portions of said edge surfaces containing said printing elements being closely spaced laterally so as to print the bar-half bar symbols in close spaced relationship;

means for mounting said coding wheels on said support member for movement therewith so that said printing elements can be brought into printing engagement with an envelope to be coded;

a detent means for detenting said code wheels in a plurality of detent positions corresponding to the printing positions of individual ones of said plurality of bar-half bar code printing elements, stop means for limiting the rotational travel of said coding wheels, and means defining a window mounted on said support member, through which said numerals can be viewed, for permitting access to the further portions of said edge surface of the coding wheels containing said numerals so as to provide direct manipulation of the coding wheels.

2. An apparatus for printing bar-half bar codes on mailing envelopes comprising: a base on which an envelope to be coded is placed; a support member pivotedly mounted on said base and movable between a first, printing position adjacent to said base, and a second, loading position out of engagement with said base; a plurality of individually rotatable coding wheels, each having a plurality of bar-half bar code printing elements along a portion of the peripheral edge surface thereof and like plurality of numerals individually corresponding to each of said plurality of bar-half bar code printing elements along a further portion of said peripheral edge surface, each printing element being located diametrically opposite to the numeral corresponding thereto so that rotation of a said coding wheel to a select position wherein a desired numeral is selected to be printed in code causes the corresponding printing elements to be moved to a printing position; means for mounting said coding wheels on said support member for movement therewith so that said printing elements can be brought into printing engagement with an envelope to be coded in the printing position of said support member; and detent means for detenting said code wheels in a plurality of detent positions corresponding to the printing positions of individual ones of said plurality of bar - half bar code printing elements, said coding wheels each including stop means thereon for limiting the rotation of said wheel, said stop means each comprising first and second stop members spaced apart on the said peripheral edge surface of the associated wheel between said numerals and said printing elements so as to limit the rotation of the associated wheel to less than 180°, the widths of said portions of said peripheral edge surfaces of said coding wheels containing said numerals being greater than the widths of said edge surfaces containing said printing elements so as to facilitate manipulation of said coding wheels, said edge surfaces containing said printing elements being closely spaced together so as to print the bar - half bar symbols in close spaced relationship, said plurality of coding wheels comprising a center wheel; first and second intermediate wheels located on either side of said center wheels; and first and second outer wheels respectively located laterally outward of said first and second intermediate wheels; said center wheel having an enlarged edge surface extending laterally outward from said center wheel on both sides thereof, said intermediate wheels each including an enlarged offset edge surface extending laterally outward away from said center wheel and said outer wheels each including an enlarged offset edge surface extending laterally outward away from said center wheel, said enlarged edge surfaces each having the same radius so that said edge surfaces present a discontinuous cylindrical surface.

3. An apparatus as claimed in claim 2 further comprising means for supplying ink to said printing elements so as to permit the printing of said code on an envelope which is positioned on said base.

4. An apparatus as claimed in claim 2 wherein said base comprises first and second flanges mounted at right angles thereon for providing proper positioning of an envelope on said base.

5. An apparatus as claimed in claim 2 wherein said detent means includes a plurality of depressions formed in each said coding wheels and arranged seriatim in a circular pattern on the side faces of wheels, and a plurality of spring-loaded detenting members for selectively engaging in said depressions so as to releasably fix the rotational positions of the individual wheels in accordance with the depressions in which the detenting members are engaged.

6. An apparatus as claimed in claim 2 wherein said mounting means comprises a housing mounted on said support member and defining an opening through which the selected numerals can be viewed.

7. An apparatus as claimed in claim 6 wherein said housing includes side walls which extend upwardly from said support member and a fixed shaft which extends between said side walls and on which said plurality of coding wheels are rotatably mounted.

* * * * *